US011358044B2

(12) United States Patent
Kwaczala et al.

(10) Patent No.: US 11,358,044 B2
(45) Date of Patent: Jun. 14, 2022

(54) UPPER BODY ROTATIONAL ASSISTIVE DEVICE

(71) Applicant: Western New England University, Springfield, MA (US)

(72) Inventors: Andrea T. Kwaczala, Suffield, CT (US); Lucia Cavacini, Natick, MA (US); Katie Wood, Westport, MA (US); Katelyn Primmer, Riverside, RI (US); Priyanka George, West Springfield, MA (US)

(73) Assignee: WESTERN NEW ENGLAND UNIVERSITY, Springfield, MA (US)

( * ) Notice: Subject to any disclaimer, the term of this patent is extended or adjusted under 35 U.S.C. 154(b) by 0 days.

(21) Appl. No.: 16/856,686

(22) Filed: Apr. 23, 2020

(65) Prior Publication Data

US 2020/0338427 A1 Oct. 29, 2020

Related U.S. Application Data

(60) Provisional application No. 62/839,137, filed on Apr. 26, 2019.

(51) Int. Cl.

| | |
|---|---|
| ***A63B 71/00*** | (2006.01) |
| ***A63B 69/36*** | (2006.01) |
| ***A63B 53/14*** | (2015.01) |
| ***A63B 60/12*** | (2015.01) |

(52) U.S. Cl.

CPC ..... *A63B 71/0009* (2013.01); *A63B 53/14* (2013.01); *A63B 60/12* (2015.10); *A63B 2209/10* (2013.01)

(58) Field of Classification Search

CPC ..... A63B 71/0009; A63B 60/28; A63B 60/34; A63B 60/0085; A63B 60/20; A63B 53/14; A63B 60/12; A63B 2209/10; A63B 2225/093

USPC ..... 473/206

See application file for complete search history.

(56) References Cited

U.S. PATENT DOCUMENTS

| | | | | |
|---|---|---|---|---|
| 4,582,325 A * | 4/1986 | Yuhara | A63B 69/36213 | 473/215 |
| 5,150,901 A * | 9/1992 | Stawicki | A63B 69/36213 | 473/215 |
| 5,306,010 A * | 4/1994 | Choi | A63B 15/005 | 473/239 |
| 5,308,062 A * | 5/1994 | Hogan | A63B 53/04 | 473/292 |
| D404,103 S * | 1/1999 | Winters | D21/791 | |
| 6,126,554 A * | 10/2000 | Poscente | A63B 69/0059 | 473/212 |
| 6,206,787 B1 * | 3/2001 | Kleppen | A63B 69/0059 | 473/207 |

(Continued)

*Primary Examiner* — Nini F Legesse

(74) *Attorney, Agent, or Firm* — Cantor Colburn LLP

(57) ABSTRACT

A rotational assistive device includes a first end portion configured for operable connection with a user, and a second end portion configured for operable connection with an implement utilized via a swinging motion. A main body portion extends between the first end portion and the second end portion. The main body portion includes a plurality of telescoping leg portions, such that when the implement and rotational assistive device are swung, the main body portion moves between a closed position having a closed length and an extended position having an extended length greater than the closed length.

19 Claims, 12 Drawing Sheets

(56) References Cited

U.S. PATENT DOCUMENTS

| | | | | |
|---|---|---|---|---|
| 6,283,522 | B1 * | 9/2001 | Renaud | A01B 1/026 294/58 |
| 6,358,156 | B1 * | 3/2002 | Moran | A63B 69/3632 473/212 |
| 6,371,863 | B1 * | 4/2002 | Moran | A63B 69/36211 473/207 |
| 6,447,402 | B2 * | 9/2002 | Moran | A63B 69/3632 473/226 |
| 6,503,148 | B2 * | 1/2003 | Lane | A63B 69/3608 473/215 |
| 6,558,266 | B2 * | 5/2003 | McMahon | A63B 69/3608 33/262 |
| 6,994,633 | B2 * | 2/2006 | Czaja | A63B 69/0059 473/227 |
| 7,083,528 | B2 * | 8/2006 | Marland | A63B 69/0059 473/212 |
| 7,128,658 | B2 * | 10/2006 | DuFour | A63B 69/3608 473/276 |
| 7,134,969 | B2 * | 11/2006 | Citron | A61F 5/026 473/277 |
| 7,513,840 | B2 * | 4/2009 | Latella, Jr. | A63B 15/00 473/219 |
| 7,993,210 | B1 * | 8/2011 | Hatfield | A63B 69/36213 473/215 |
| 8,562,451 | B2 * | 10/2013 | Crabtree | A63B 69/0059 473/215 |
| 8,696,481 | B1 * | 4/2014 | Allen | A63B 69/3676 473/208 |
| 9,700,775 | B2 * | 7/2017 | Hamilton | A63B 69/0002 |

* cited by examiner

UPPER BODY ROTATIONAL ASSISTIVE DEVICE

CROSS REFERENCE TO RELATED APPLICATION

This application claims benefit of U.S. Provisional Application No. 62/839,137 filed on Apr. 26, 2019, which is incorporated herein by reference in its entirety.

BACKGROUND

Exemplary embodiments pertain to the art of body stabilization and assistive devices.

After suffering a stroke, many patients are afflicted with a condition called hemiparesis, in which one side of the body has limited mobility. In particular, right-sided hemiparesis is the result of a stroke causing left brain damage, resulting in limited mobility on the right side of the body. Patients with right-sided hemiparesis usually also have difficulty speaking and understanding speech; this is because Broca's area and Wernicke's area are both located on the left side of the temporal lobe and are more sensitive to cell damage during poor blood flow.

Studies show that approximately 88% of stroke survivors experience some sort of hemiparesis. The likelihood of hemiparesis has not been proven to correlate to age or gender and there does not appear to be a prevalence of either left- or right-sidedness, though there has been evidence that hemiparesis occurs more often in women than men when patients are over the age of 75. Recovery of lost motor ability in stroke patients is dependent on the severity of the stroke they experienced. Patients with mild strokes have been shown to gain back approximately 46% of their lost mobility after a six-month recovery period that included physical therapy. However, in that same time period, severe stroke survivors have been shown to only gain back approximately 7% of their lost mobility. The percent of mobility recovery, like with the occurrence of hemiparesis, seems to be independent of age and gender.

Strokes and hemiparesis have profound and lasting effects on the lives of patients. The loss of mobility and speech result in patients very often needing the assistance of others both in and out of their homes. Stroke patients lose their sense of independence for even the simplest activities of daily living (ADLs), including toileting, preparing meals, grooming, dressing, and social interaction. Many patients afflicted with hemiparesis also need to stop participating in recreational activities that they were involved in prior to their strokes, largely due to impaired mobility, balance, and cardiovascular fitness. Some of these recreational activities include fishing, golf, basketball, tennis, dancing, and knitting. To many patients, losing the ability to take part in a favorite recreational activity is just as upsetting as losing the ability to perform key ADLs.

BRIEF DESCRIPTION

In one embodiment, a rotational assistive device includes a first end portion configured for operable connection with a user, and a second end portion configured for operable connection with an implement utilized via a swinging motion. A main body portion extends between the first end portion and the second end portion. The main body portion includes a plurality of telescoping leg portions, such that when the implement and rotational assistive device are swung, the main body portion moves between a closed position having a closed length and an extended position having an extended length greater than the closed length.

Additionally or alternatively, in this or other embodiments the main body portion is operably connected to at least one of the first end portion or the second portion via a ball-and-socket joint allowing for multi-axis relative movement.

Additionally or alternatively, in this or other embodiments the second end portion includes a clamping mechanism to secure the second end portion to the implement.

Additionally or alternatively, in this or other embodiments the first end portion includes a block operably connecting the first end portion to the main body portion and a handle extending from the block. The handle is configured for operable connection with the user.

Additionally or alternatively, in this or other embodiments the handle is one of rod-shaped or spherical.

Additionally or alternatively, in this or other embodiments the handle is shaped utilizing a cast of the user's hand.

Additionally or alternatively, in this or other embodiments the handle is connected to the block via a quick release mechanism.

Additionally or alternatively, in this or other embodiments the closed length is between about 40 centimeters and 60 centimeters.

Additionally or alternatively, in this or other embodiments the extended length is between about 80 centimeters and 100 centimeters.

In another embodiment, a golf club system includes a golf club having a club shaft, a club head located at a first end of the club shaft, and a grip located at a second end of the club shaft opposite the first end. A rotational assistive device is operably connected to the golf club and includes a first end portion configured for operable connection with a user, a second end portion operable connected to the golf club, and a main body portion extending between the first end portion and the second end portion. The main body portion includes a plurality of telescoping leg portions, such that when the golf club and rotational assistive device are swung, the main body portion moves between a closed position having a closed length and an extended position having an extended length greater than the closed length.

Additionally or alternatively, in this or other embodiments the main body portion is operably connected to at least one of the first end portion or the second portion via a ball-and-socket joint allowing for multi-axis relative movement.

Additionally or alternatively, in this or other embodiments the second end portion includes a clamping mechanism to secure the second end portion to the club shaft.

Additionally or alternatively, in this or other embodiments the first end portion includes a block operably connecting the first end portion to the main body portion and a handle extending from the block, the handle configured for operable connection with the user.

Additionally or alternatively, in this or other embodiments the handle is one of rod-shaped or spherical.

Additionally or alternatively, in this or other embodiments the handle is shaped utilizing a cast of the user's hand.

Additionally or alternatively, in this or other embodiments the handle is connected to the block via a quick release mechanism.

Additionally or alternatively, in this or other embodiments the closed length is between about 40 centimeters and 60 centimeters.

Additionally or alternatively, in this or other embodiments the extended length is between about 80 centimeters and 100 centimeters.

Additionally or alternatively, in this or other embodiments the swing is accomplished with a first hand of the user at the first end portion and a second hand of the user at the grip of the gold club.

Additionally or alternatively, in this or other embodiments a locking mechanism is located at the main body portion to selectably prevent movement of the main body portion between the closed position and the extended position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed herein are embodiments of a biomechanical attachment to a subject, configured to assist in stabilization and rotation of the subject throughout a motion of the subject, such as a golf swing. The device is configured to aide in rotation, and to provide an increase in power of the motion.

Figure 1:
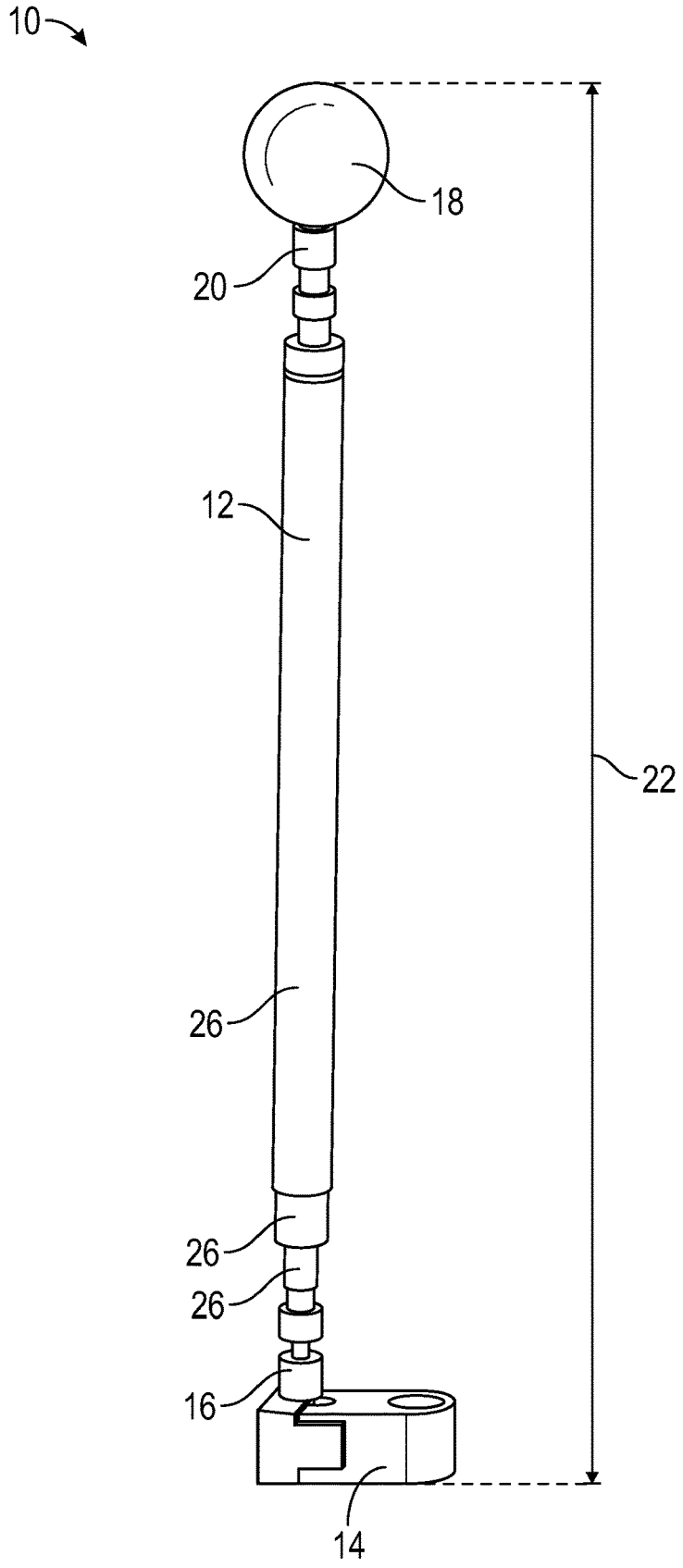
FIG. 1 is a schematic illustration of an embodiment of a rotational assistive device in a closed position.
Figure 2:
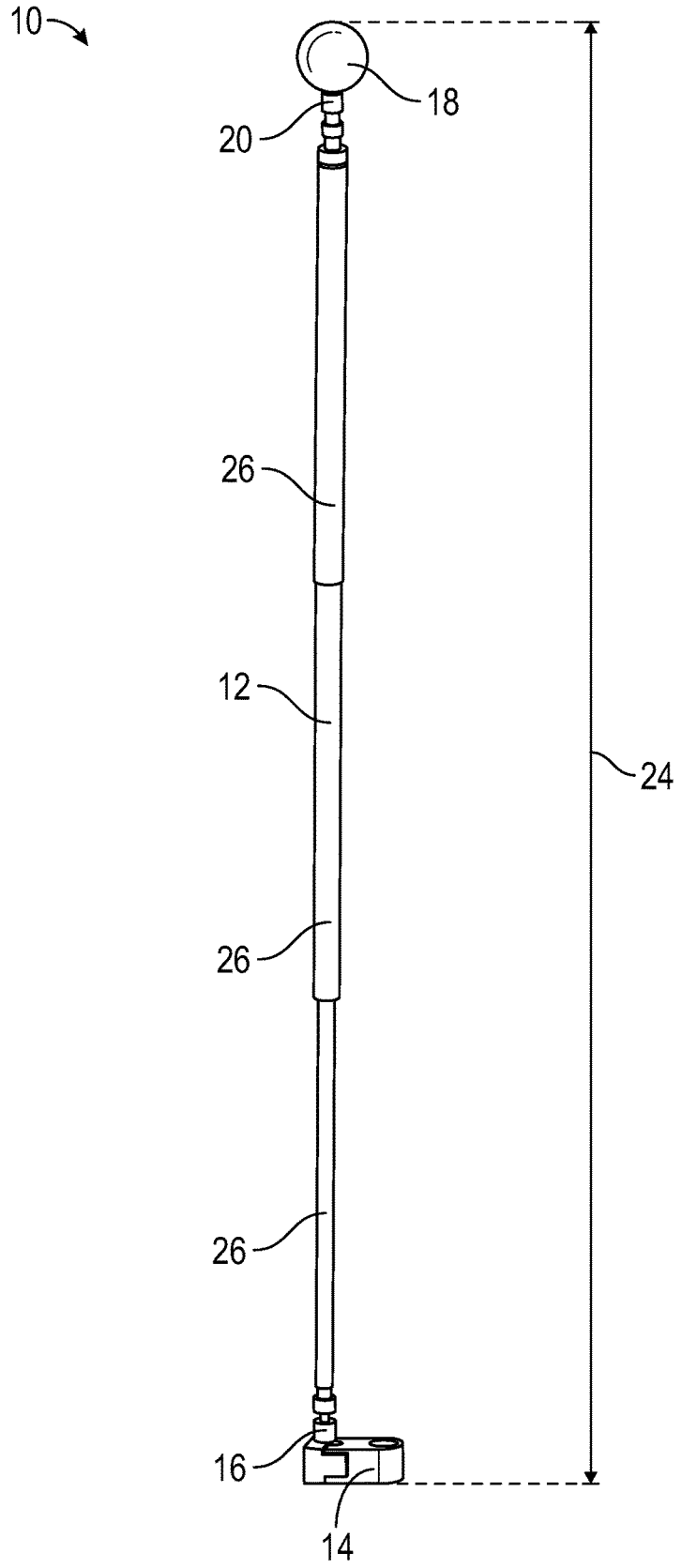
FIG. 2 is a schematic illustration of an embodiment of a rotational assistive device in an extended position.

Referring to FIG. 1, shown is an embodiment of a rotational assistive device 10. The device 10 includes a main body 12, an device attachment portion 14 at a first end 16 of the main body 12, and a body attachment portion 18 at a second end 20 of the main body 12 opposite the first end 16. The device 10, and more specifically the main body 12, is extendible from a first or closed position as shown in FIG. 1, to an extended position as illustrated in FIG. 2. In some embodiments, in the closed position the device 10 has a closed length 22 between about 40 and 60 centimeters (15.74" and 23.62"). In some embodiments, an extended length 24 as shown in FIG. 2 is between about 80 centimeters and 100 centimeters (31.49" and 39.37"). It is to be appreciated, however, that these closed lengths 22 and extended lengths 24 are merely exemplary and that other closed lengths 22 and extended lengths 24 may be utilized depending on, for example, a user's anthropometrics and/or the tool, such as a golf club, utilized with the device 10. To move between the closed position and the extended position, the main body 12 utilizes a plurality of telescoping leg portions 26. In some embodiments, three such leg portions 26 are utilized, while in other embodiments other quantities of leg portions 26, such as two, four or five leg portions 26 are utilized.

Figure 3:
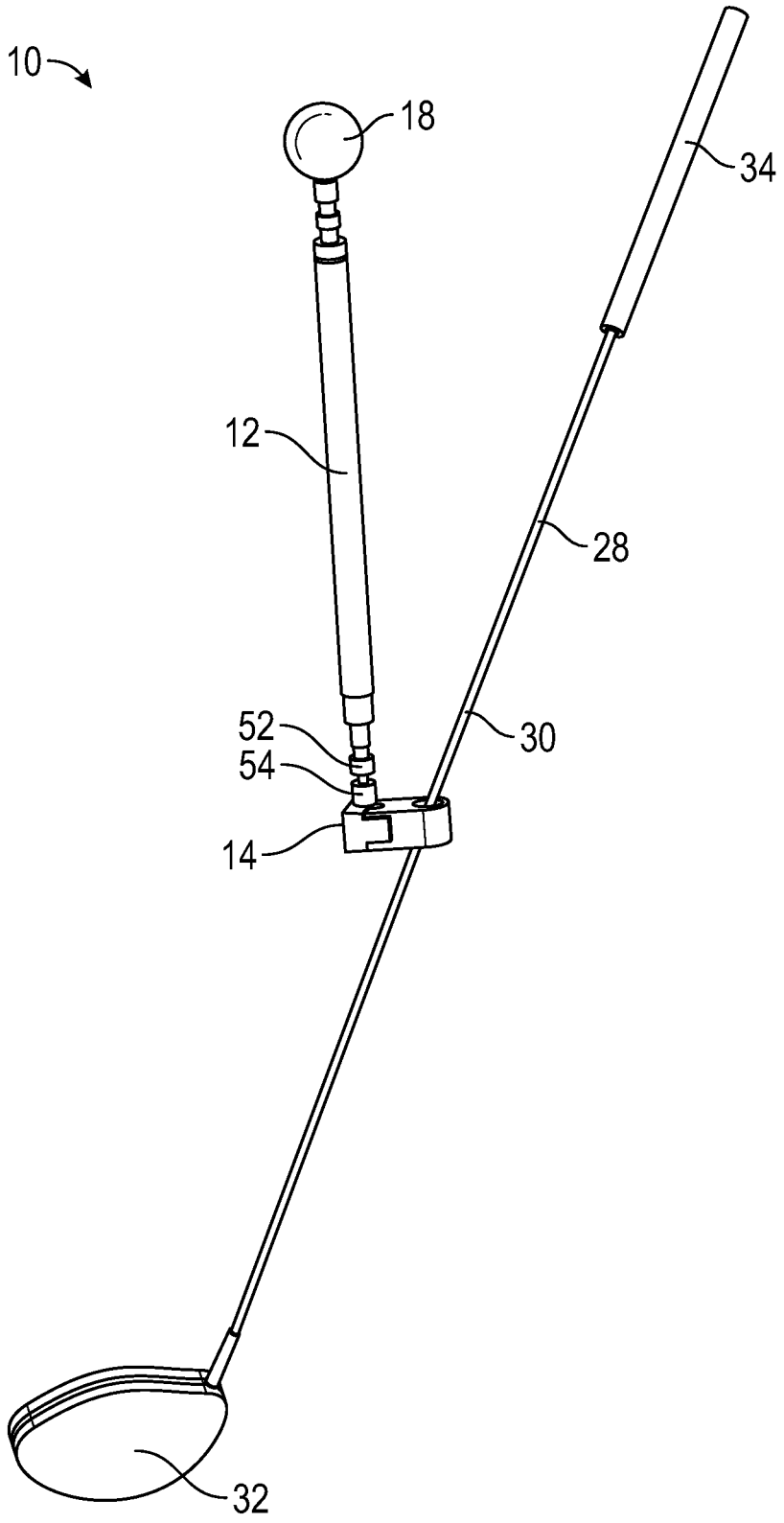
FIG. 3 is a schematic illustration of an embodiment of a rotational assistive device operably connected to a golf club.

Referring to FIG. 3, the device 10 is operably connected to a golf club 28. While a golf club 28 is shown in FIG. 3, it is to be appreciated that the device 10 may be connected to and utilized with other implements, such as garden tools or the like. As shown, the golf club 28 includes a club shaft 30, with a club head 32 located at a first end of the club shaft 30 and a grip 34 located at a second end of the club shaft 30 opposite the first end. The device attachment portion 14 is secured to the club shaft 30.

Figure 4A:
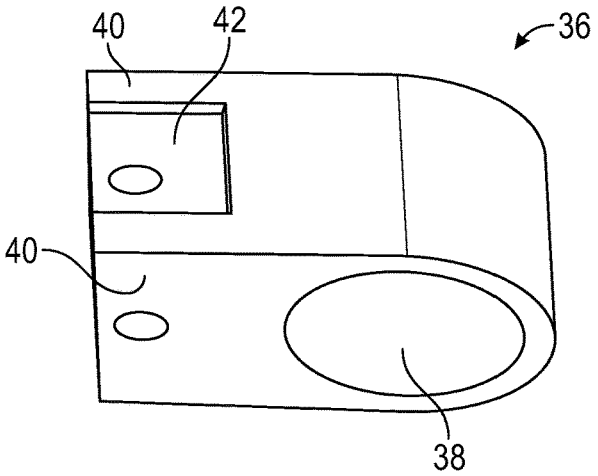
FIGS. 4A-4C illustrate an embodiment of a device attachment portion of a rotational assistive device.
Figure 4B:
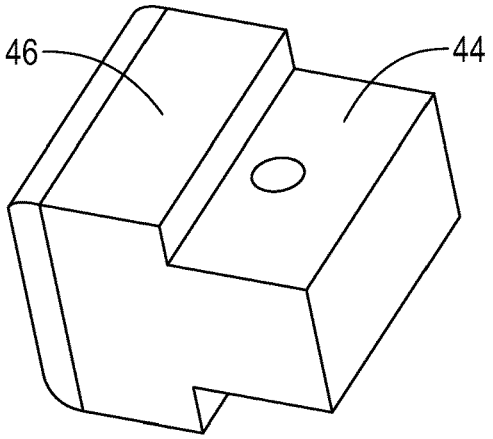
Figure 4C:
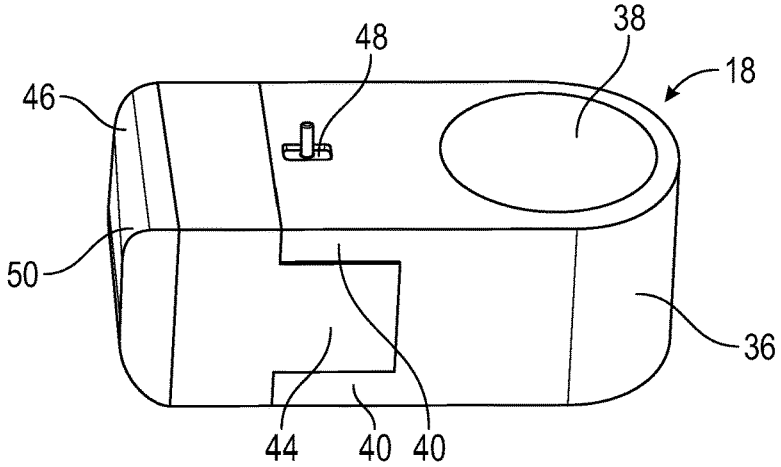

In some embodiments, as illustrated in FIG. 4A-4C, the device attachment portion 14 includes a female adapter 36 having an opening 38 that wraps around the club shaft 30. In some embodiments, the female adapter 36 is secured to the club shaft 30 by, for example, a tightening or clamping mechanism. The female adapter 36 further includes two adapter arms 40 defining an adapter groove 42 between the adapter arms 40. An engagement portion 44 of a male adapter 46 fits into the adapter groove 42 and is secured in the adapter groove 42 by, for example, an adapter pin 48 inserted through the adapter arms 40 and the engagement portion 44. The male adapter 46 further includes an adapter socket 50 into which an adapter ball 52 of the main body 12 is secured. This allows for multi-axial movement of the main body 12 relative to the device attachment portion 14, and thereby relative to the golf club 28, as illustrated in FIG. 3. The attachment portion 14 is configured to allow for attachment and detachment of the device 10 from golf clubs 28, so the device 10 can be used with multiple golf clubs 28 during the course of play.

Figure 5B:
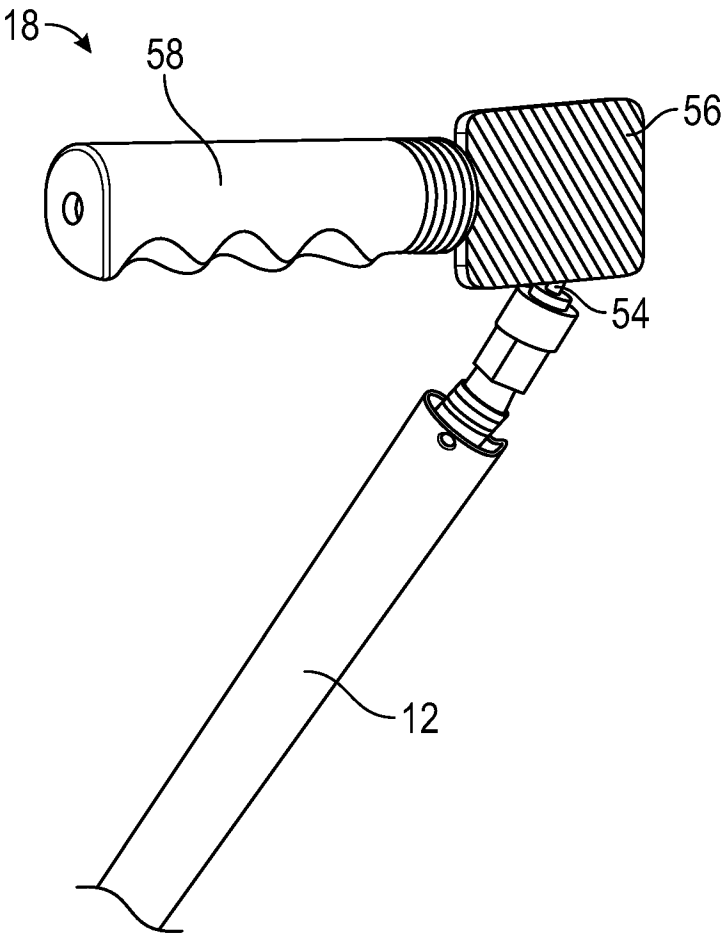
FIGS. 5A-5E illustrate embodiments of a body attachment portion of a rotational assistive device.
Figure 5A:
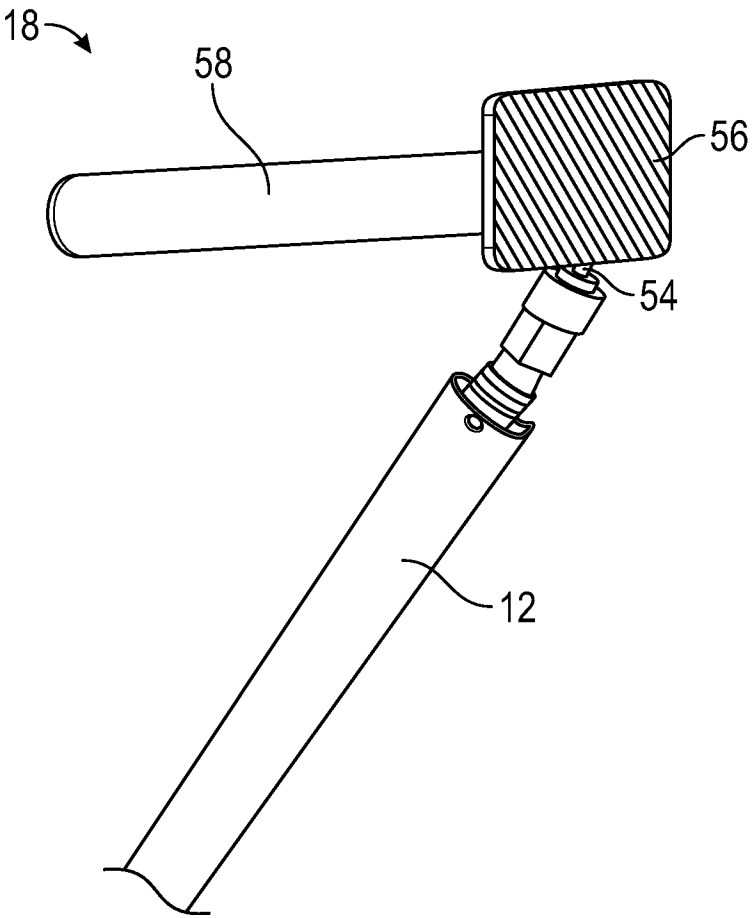
Figure 5C:
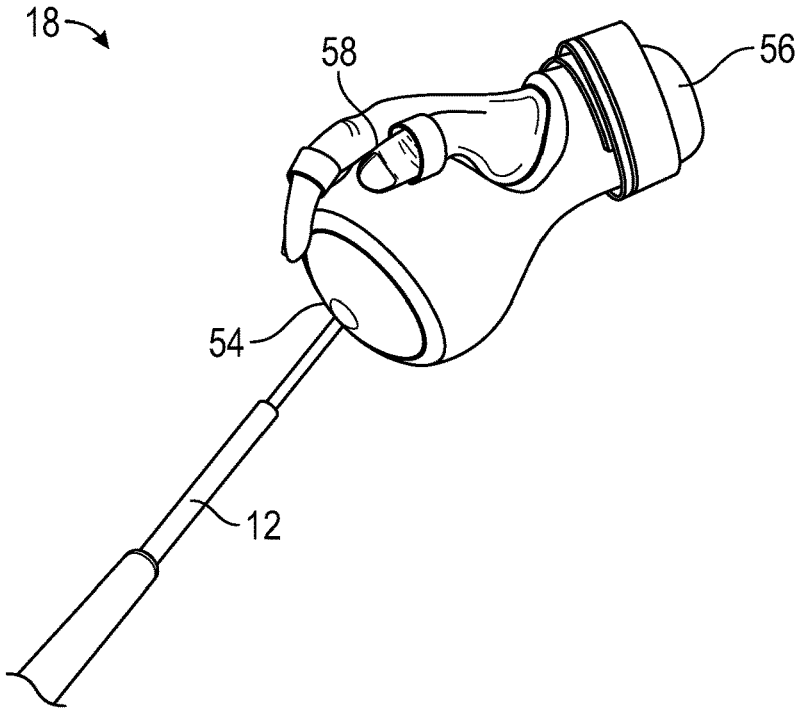
Figure 5D:
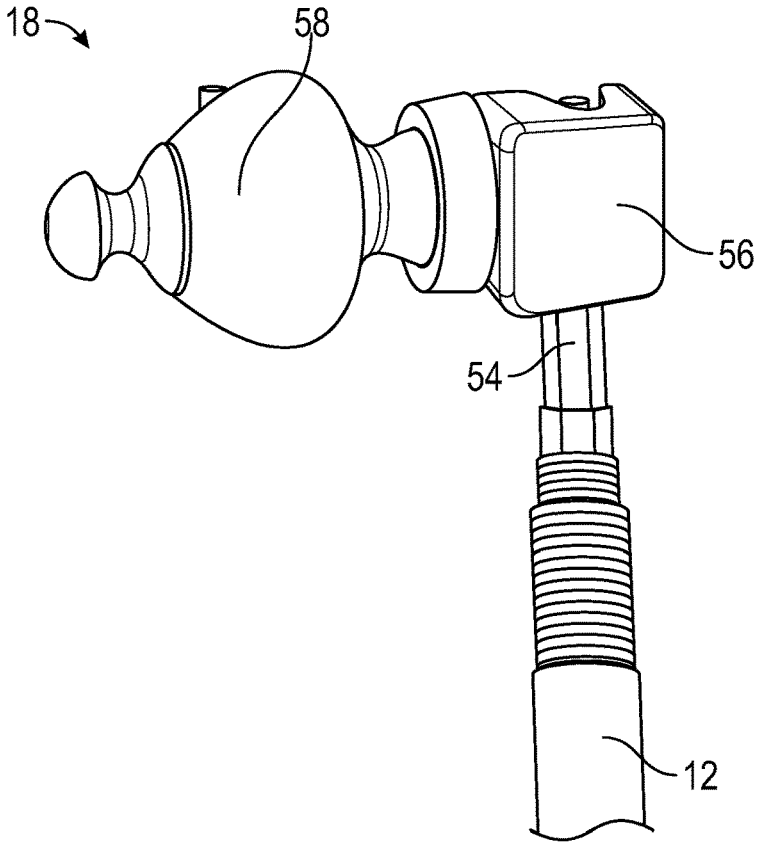
Figure 5E:
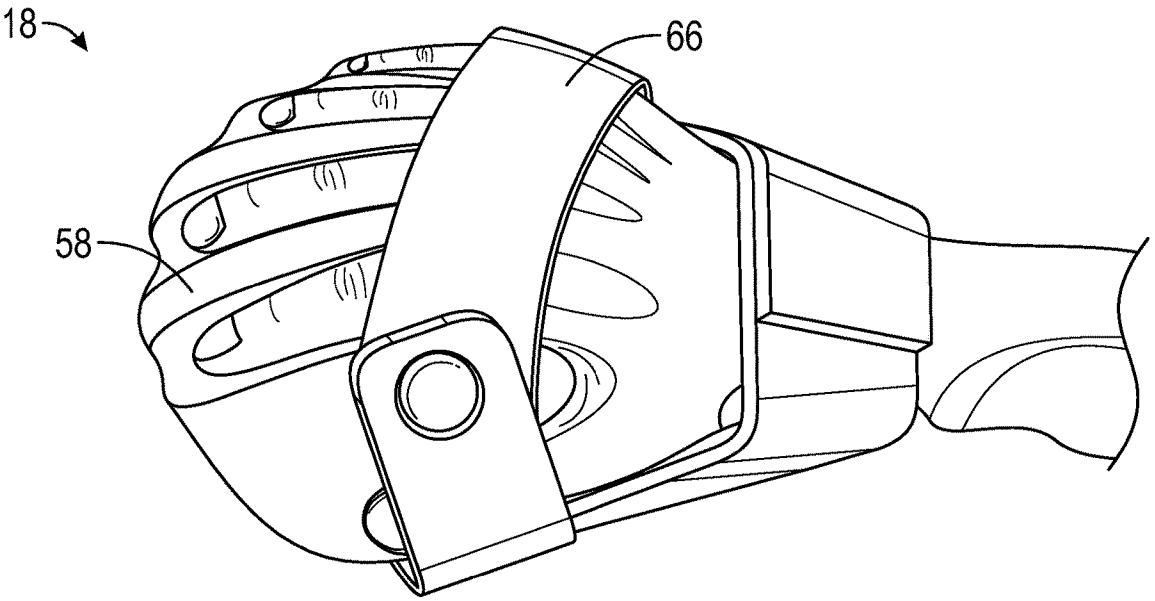

Referring now to FIG. 5A the body attachment 18 is connected to the main body 12 through a ball and socket joint 54, which allows for multi-axis movement of the body attachment 18 relative to the main body 12. As shown in FIG. 5A, in some embodiments the body attachment 18 includes a block 56 secured to the main body 12 and a handle 58 extending from the block 56. In some embodiments, such as shown in FIG. 5A, the handle 58 is a dowel formed from, for example, wood or another material. In other embodiments, such as shown in FIG. 5B, the handle 58 is shaped like a wheelchair handle, bicycle handlebar grip or the like. In still another embodiment, shown in FIG. 5C, the handle 58 is spherical in shape to aid in passive extension of the fingers, or may be an oblong spherical shape with a nodule 60 such as in FIG. 5D. In other embodiments, such as in FIG. 5E, the handle 58 is shaped using a mold of a user's hand to result in a custom handle 58 with a personalized fit to match the user's condition.

Figure 6:
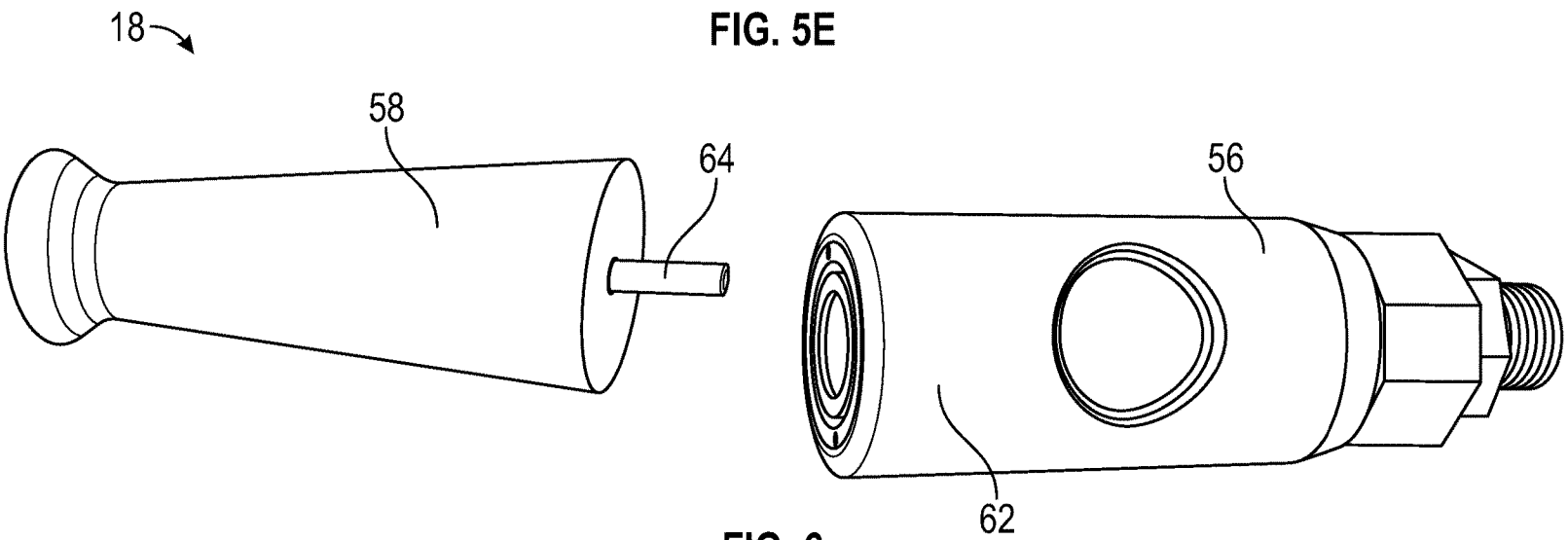
FIG. 6. Illustrates an embodiment of a quick release connection of a body attachment portion of a rotational assistive device.

Referring now to FIG. 6, the body attachment 18 may be configured to allow for replacement of handles 58. For example, the embodiment of FIG. 6 includes a quick release mechanism 62 in the block 56 interactive with a quick release pin 64 of the handle 58. The quick release mechanism 62 is activated by, for example, a button on the black 56, which when depressed releases the quick release pin 64.

Figure 8:
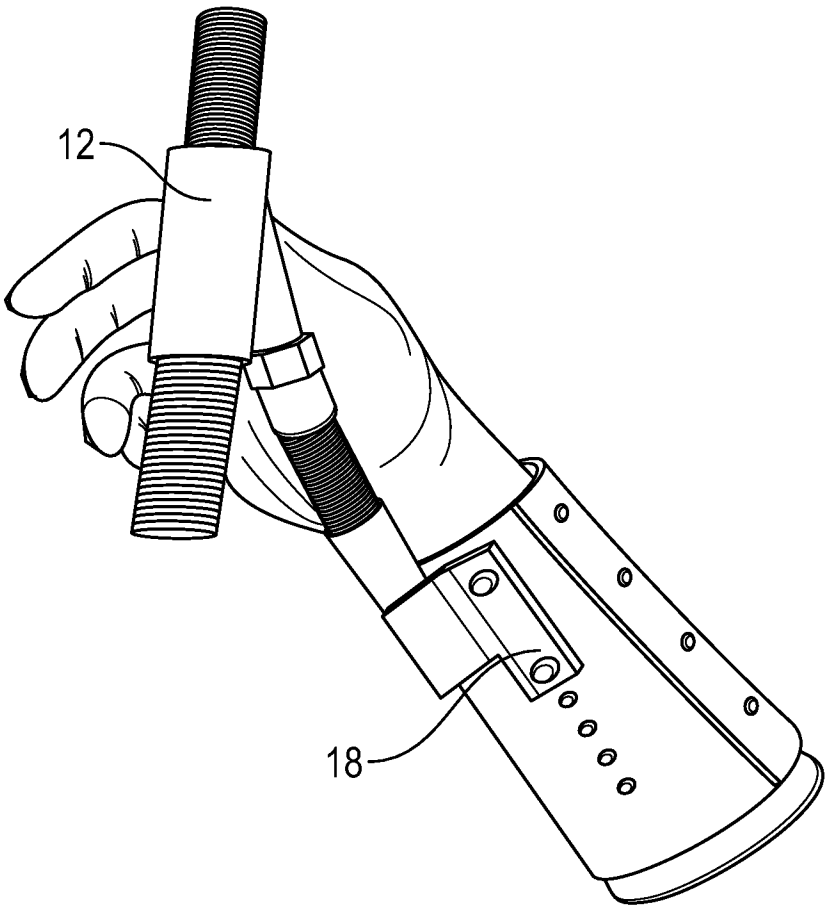
FIG. 8 illustrates yet another embodiment of a body attachment portion of a rotational assistive device.
Figure 7:
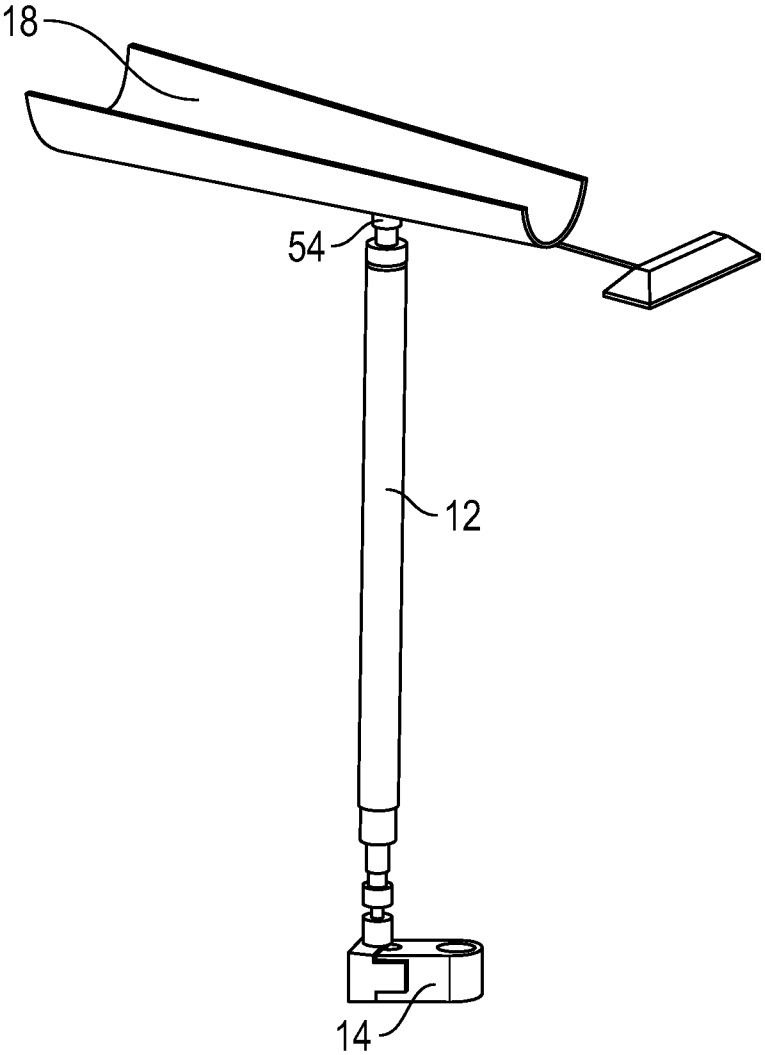
FIG. 7 illustrates another embodiment of a body attachment portion of a rotational assistive device.
Figure 9:
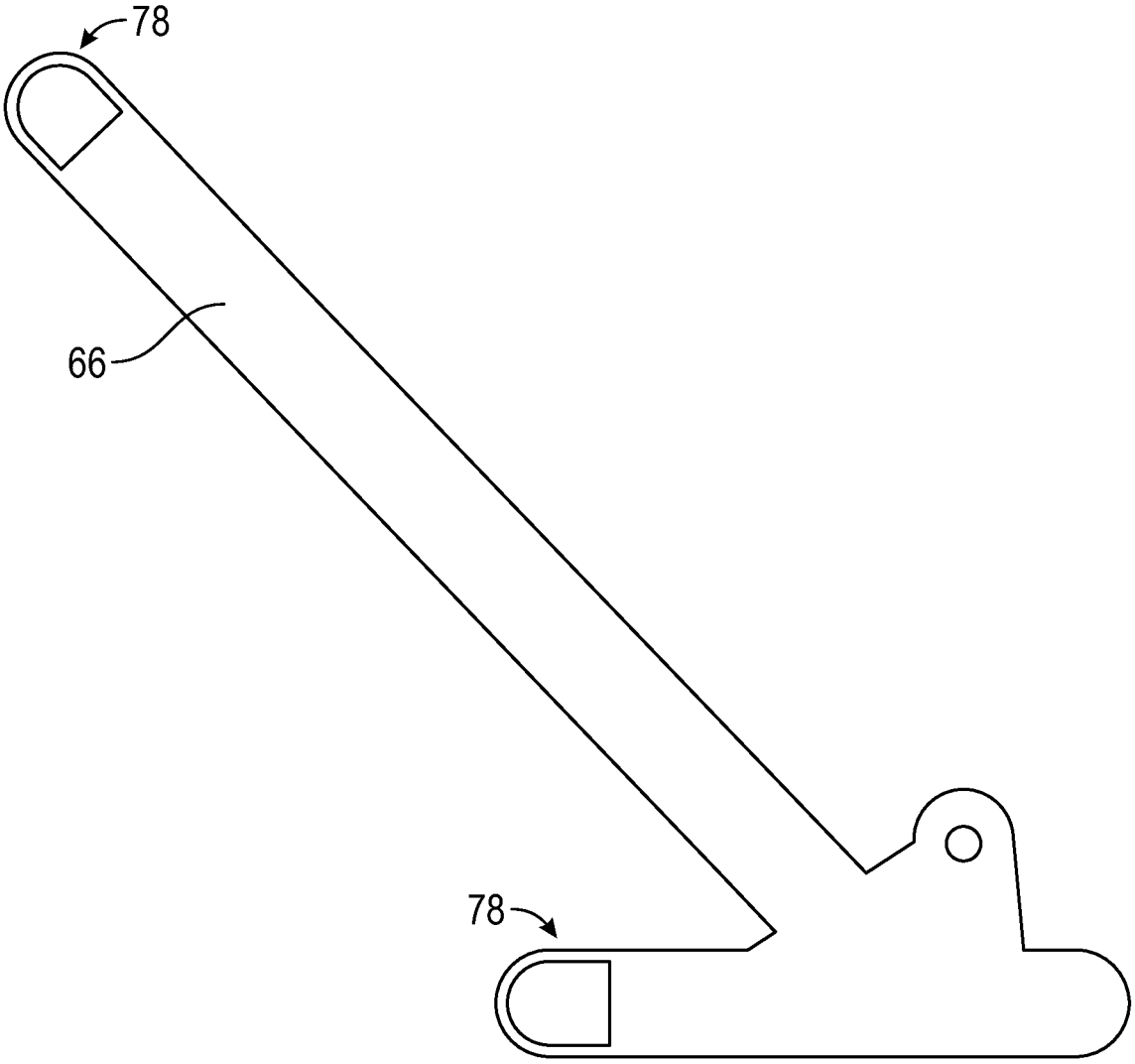
FIG. 9 illustrates an embodiment of an attachment strap for a rotational assistive device.

In other embodiments, such as in FIG. 7, the body attachment 18 is a rigid forearm sleeve or a wrist cuff such as shown in FIG. 8, so the device 10 may be utilized by a user with limited or no use of the hand. Referring to FIG. 9, some embodiments of the body attachment 18 may include a strap 66 secured to the handle 58 and wrapped around the user's hand to securely connect the user's hand to the device 10 at the handle 58. The strap 66 may utilize hook and loop fastener 78 to secure the hand in place.

Figure 10:
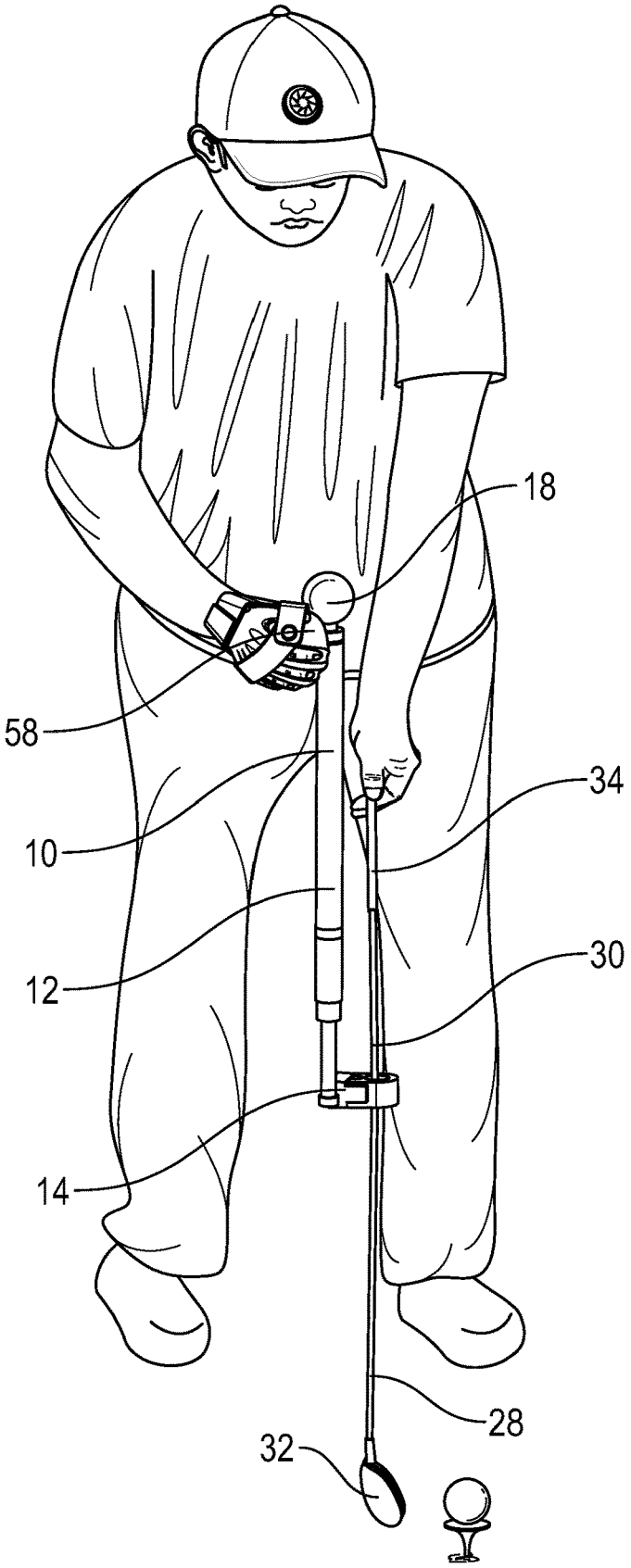
FIG. 10 illustrates use of the rotational assistive device at a beginning of a swing.
Figure 11:
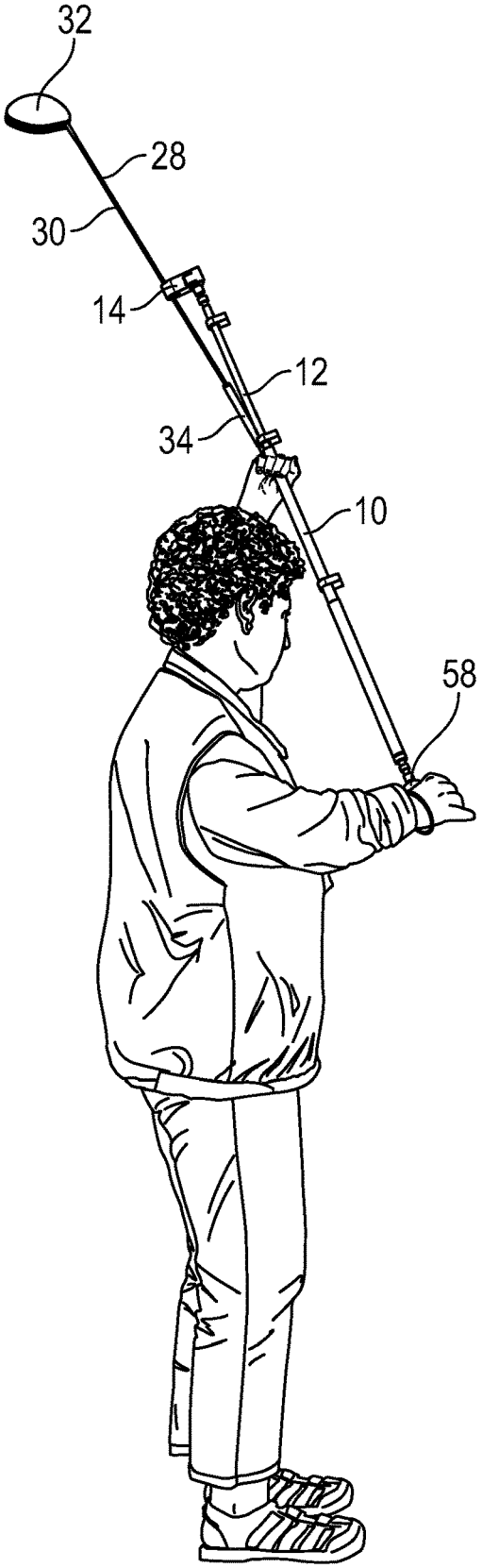
FIG. 11 illustrates use of the rotational assistive device at or near an end of a swing.

Use of the device 10 will now be described with reference to FIGS. 10 and 11. FIG. 10 illustrates a user at the beginning of a golf swing. The device 10 is connected to the club shaft 30 as described above. The user holds the golf club 28 with one hand via the grip 34 and holds the device 10 with the other hand via the handle 58. At the beginning of the swing the main body 12 is in the closed position. FIG. 11 illustrates the end of the swing, or the follow through. In the follow through, the main body 12 is in the extended position. As the swing proceeds from the beginning of the swing to the end of the swing, the main body 12 freely moves from the closed position to the extended position due to the centripetal forces acting on the main body 12. This extension of the main body 12 allows the golf club 28, in particular the club head 32 to move through a typical swing path.

Figure 13:
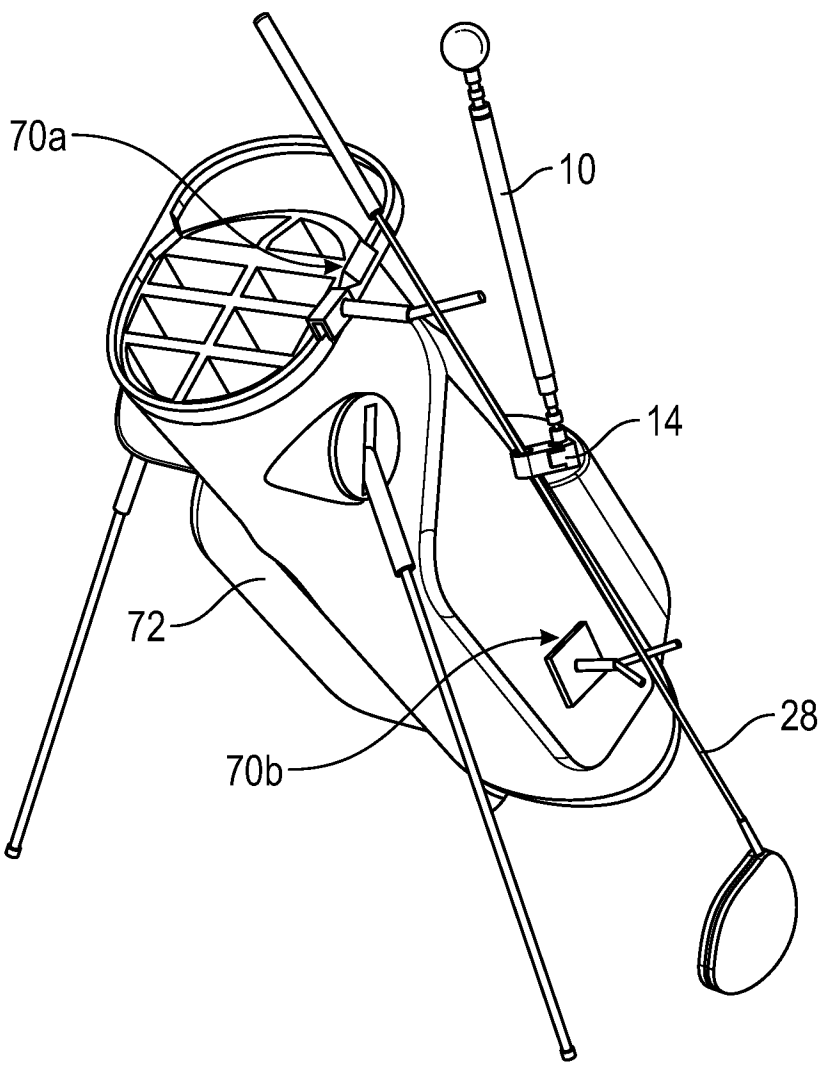
FIG. 13 illustrates a device support for use with a rotational assistive device.
Figure 12:
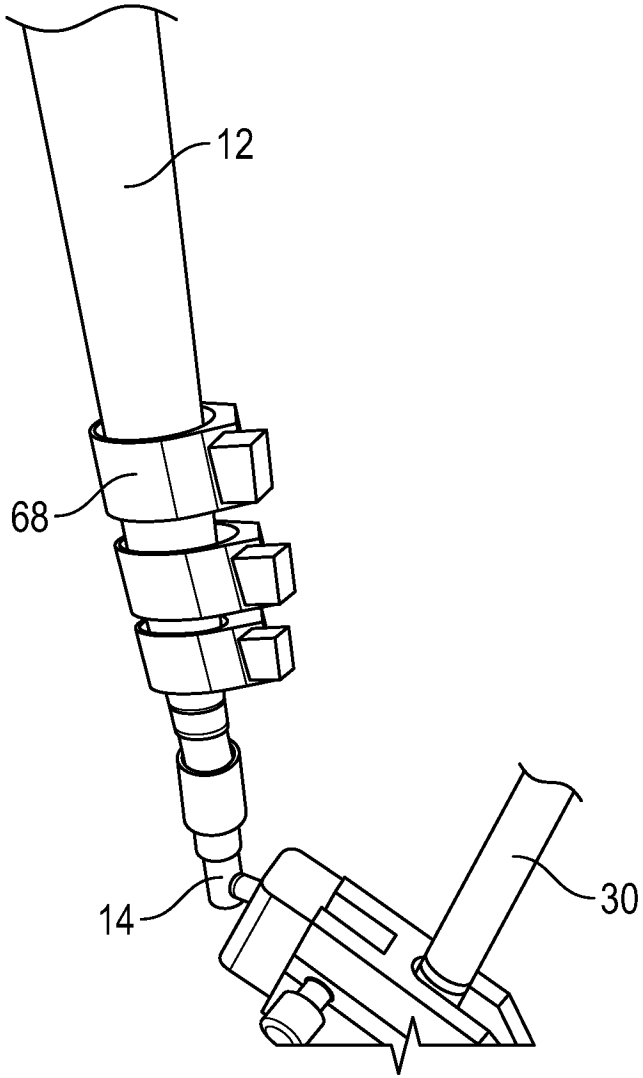
FIG. 12 illustrates a locking mechanism of a rotational assistive device.

In some embodiments, one or more components may be included to improve the ease of use of the device. As shown in FIG. 12, the one or more components may include a lock 68 on the main body 12 to secure the leg portions 26 and prevent movement of the main body 12 between the closed position and the extended position. The lock 68 may be useful for storage or carrying of the device 10, or when detaching and attaching the device 10 to a golf club 28. Referring to FIG. 13, some embodiments may include one or more supports 70 utilized with a golf club bag 72. An upper support 70*a* and/or a lower support 70*b* may be secured to the golf club bag 72 to provide a club rest for the gold club 28 with or without the device 10 attached.

The embodiments disclosed herein have the technical effect of stabilizing and enhancing the swing of the user utilizing the device 10 attached to the gold club 28. The device 10 provides a means for the user to utilize a two-handed swing with improved torso rotation. These factors improve power, accuracy and repeatability of the swing.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A rotational assistive device, comprising:

a first end portion configured for operable connection with a user via a handle disposed at the first end portion;

a second end portion configured for operable connection with an implement utilized via a swinging motion; and a main body portion extending between the first end portion and the second end portion, the main body portion including a plurality of telescoping leg portions, such that when the implement and rotational assistive device are swung, the main body portion moves between a closed position having a closed length and an extended position having an extended length greater than the closed length;

wherein the main body portion is operably connected to at least one of the first end portion or the second portion via a ball-and-socket joint allowing for multi-axis relative movement.

2. The rotational assistive device of claim 1, wherein the second end portion includes a clamping mechanism to secure the second end portion to the implement.

3. The rotational assistive device of claim 1, wherein the handle is one of rod-shaped or spherical.

4. The rotational assistive device of claim 1, wherein the handle is shaped utilizing a cast of the user's hand.

5. The rotational assistive device of claim 1, wherein the closed length is between about 40 centimeters and 60 centimeters.

6. The rotational assistive device of claim 1, wherein the extended length is between about 80 centimeters and 100 centimeters.

7. A rotational assistive device, comprising:

a first end portion configured for operable connection with a user via a handle disposed at the first end portion;

a second end portion configured for operable connection with an implement utilized via a swinging motion; and a main body portion extending between the first end portion and the second end portion, the main body portion including a plurality of telescoping leg portions, such that when the implement and rotational assistive device are swung, the main body portion moves between a closed position having a closed length and an extended position having an extended length greater than the closed length;

wherein the first end portion includes:

a block operably connecting the first end portion to the main body portion; and the handle extending from the block.

8. The rotational assistive device of claim 7, wherein the handle is connected to the block via a quick release mechanism.

9. A golf club system, comprising:

a golf club including:

a club shaft;

a club head disposed at a first end of the club shaft; and a grip disposed at a second end of the club shaft opposite the first end; and a rotational assistive device, including:

a first end portion configured for operable connection with a user via a handle disposed at the first end portion;

a second end portion operable connected to the golf club; and a main body portion extending between the first end portion and the second end portion, the main body portion including a plurality of telescoping leg portions, such that when the golf club and rotational assistive device are swung, the main body portion is movable between a closed position having a closed length and an extended position having an extended length greater than the closed length.

10. The golf club system of claim 9, wherein the main body portion is operably connected to at least one of the first end portion or the second portion via a ball-and-socket joint allowing for multi-axis relative movement.

11. The golf club system of claim 9, wherein the second end portion includes a clamping mechanism to secure the second end portion to the club shaft.

12. The golf club system of claim 9, wherein the first end portion includes:

a block operably connecting the first end portion to the main body portion; and the handle extending from the block.

13. The golf club system of claim 12, wherein the handle is connected to the block via a quick release mechanism.

14. The golf club system of claim 9, wherein the handle is one of rod-shaped or spherical.

15. The golf club system of claim 9, wherein the handle is shaped utilizing a cast of the user's hand.

16. The golf club system of claim 9, wherein the closed length is between about 40 centimeters and 60 centimeters.

17. The golf club system of claim 9, wherein the extended length is between about 80 centimeters and 100 centimeters.

18. The golf club system of claim 9, wherein the swing is accomplished with a first hand of the user at the first end portion and a second hand of the user at the grip of the golf club.

19. The golf club system of claim 9, further comprising a locking mechanism at the main body portion to selectably prevent movement of the main body portion between the closed position and the extended position.

* * * * *